United States Patent [19]

Tardiff

[11] 4,097,037

[45] Jun. 27, 1978

[54] TABLE WITH LEAF AND LOCKING SYSTEM

[75] Inventor: Victor H. Tardiff, San Jacinto, Calif.

[73] Assignee: Tru-Eze Manufacturing Co., Inc., Temecula, Calif.

[21] Appl. No.: 813,844

[22] Filed: Jul. 8, 1977

[51] Int. Cl.[2] ..... A61G 13/00

[52] U.S. Cl. ..... 269/323

[58] Field of Search ..... 269/322-326; 108/6, 9; 5/62, 66-69

[56] References Cited

U.S. PATENT DOCUMENTS

| | | | |
|---|---|---|---|
| 602,571 | 4/1898 | Bowers | 269/324 |
| 3,089,692 | 5/1963 | Blomquist | 269/323 |
| 3,203,373 | 8/1965 | King | 5/62 |
| 3,640,520 | 2/1972 | Wieland et al. | 5/62 |

FOREIGN PATENT DOCUMENTS

| | | | |
|---|---|---|---|
| 97,241 | 10/1931 | Sweden | 5/62 |

*Primary Examiner*—Robert C. Watson
*Attorney, Agent, or Firm*—Donald D. Mon

[57] ABSTRACT

A table includes a platform comprising a horizontal surface and an upright support beneath the horizontal surface, the support having a dimension of height. A first hinge hinges a leaf to the platform and a three link lock system interlinks the leaf and the platform so the leaf can be locked in a plurality of angular adjusted positions. The three link system includes a part of the leaf, a part of the support, and a shaft which is pivotally mounted to the leaf. The shaft is shiftable in the lock so as to vary the length of one of the links.

9 Claims, 8 Drawing Figures

27
31
32
25
26
10
7
12
13
33
30
8
35
50
59
11
36
37
22
23
34
17,20
15,18
14
16,19
7

54
52
51
50
32
37
38
34
33
39
40
48
46
45
43
41
44
35
42
53

25
15
31
32
3
31'
32'
18
45
56
35
43
41
43'
41b
41a
16
55
19
42
12
3

TABLE WITH LEAF AND LOCKING SYSTEM

This invention relates to tables, and especially to treatment tables in the use of which part of the torso rests on a horizontal surface and another part rests on a leaf which can be adjusted to a plurality of angular positions relative to the horizontal.

Especially in the traction treatment of back ailments, part of the torso is laid flat on a horizontal surface, but it is desirable to adjust the angular position of the upper part of the torso. Tables exist for this purpose, and there are existing locking systems for this purpose. However, most prior art locking systems involve inherent difficulties in making quick and smooth adjustment of the angulation, and are sensitive to vibration. Sometimes the lock lets loose and drops the patient's upper torso with a consequent risk of hurting him.

Furthermore, many locking systems are relatively crude in appearance and operation. When it is considered that this table is primarily (but not exclusively) intended for use in the healing arts, then simplicity, reliability and elegance of appearance and function are obviously desirable.

It is an object of this invention to provide a reliable, self-locking, readily adjustable lock system for a table having a pivoted leaf.

A system according to this invention is used in combination with a platform, with a horizontal surface having an upright support beneath the horizontal surface, the support having a dimension of height. A horizontal first hinge means is mounted to the platform and a leaf is mounted to the first hinge means. A horizontal second hinge means is mounted on the leaf, spaced from the first hinge means. A lock shaft is pivotally mounted to the second hinge means. Lock means is pivotally mounted to the support by a third hinge means below the horizontal surface. A three link locking system is thereby created for locking the leaf. The three link system includes a first rigid link between the lock means and the first hinge means, a second rigid link between the first and second hinge means, and a third rigid link between the second hinge means and the lock means (or the third hinge means). The shaft is slideably connected to the lock means, so that when the lock means is loosened the leaf can be raised up or down, the length of the third link changing as required. By locking the lock means, the leaf is held at a selected adjusted angular position.

According to a preferred but optionable feature of this invention, the lock means comprises a channel in which the shaft is slidable, an idler gear engaging rack teeth on the shaft, and a lock gear which is engagable with the teeth on the rack and on the idler gear to lock them and thereby prevent further axial movement of the shaft.

The above and other features of this invention will be fully understood from the following detailed description and accompanying drawings in which.

Figure 1:
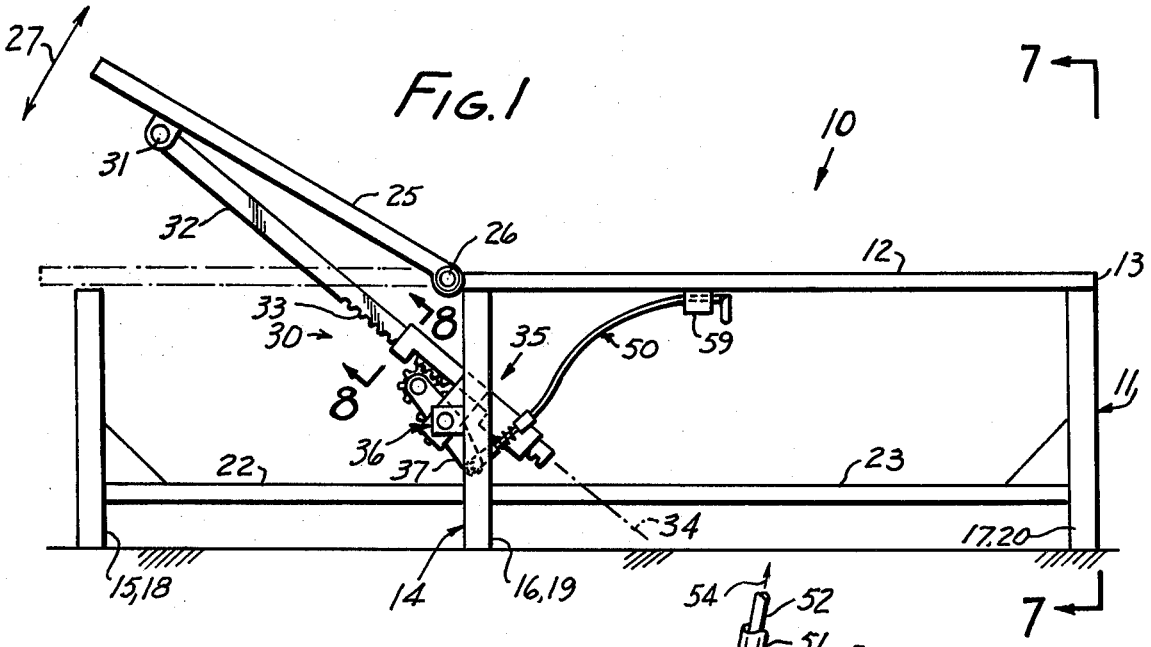
FIG. 1 is a side elevation showing the presently preferred embodiment of the invention.
Figure 7:
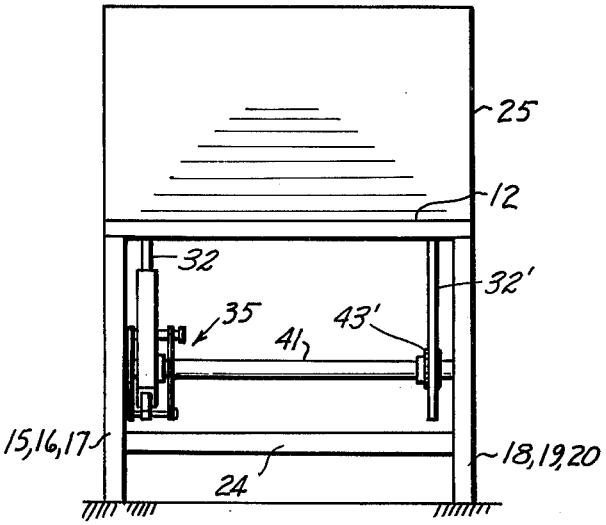
FIG. 7 is a right hand elevation taken at line 7 — 7 in FIG. 1.
Figure 8:
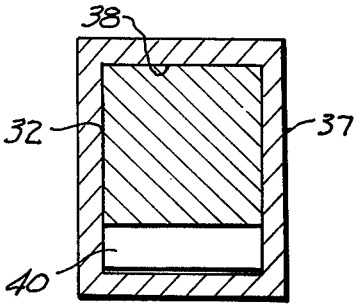
FIG. 8 is a cross section taken at line 8 — 8 in FIG. 1.

In FIG. 1 there is shown a table 10 which includes a platform 11. By definition, the platform includes a horizontal surface 12 formed on a flat plate 13 and facing upward, and a support 14. Support 14 comprises a plurality of upright leg members 15, 16, 17. Leg members 18, 19 and 20 are directly behind leg members 15, 16 and 17 in FIG. 1. Transverse members such as members 22, 23 connect members 15, 16, 17 and 18, 19, 20 respectively while cross members such as member 24 (FIG. 7) join the (legs in) a rectangular array. The plate itself is attached to the tops of leg members 16, 17, 19 and 20. The platform is rigid.

A leaf 25 is joined to the platform by horizontal first hinge means 26 so that the leaf pivot up and down in arc 27. As shown, the lower position of the leaf is limited by the top of upright leg members 15 and 18. It is possible to make these leg members shorter to permit the leaf to tilt downwardly below the horizontal if desired.

It is the object of this invention to permit the leaf to be hinged to any desired angular position within its limits, and to be locked there until released. For this purpose a locking system 30 is provided.

The leaf is rigid, and at a position spaced from the first hinge means horizontal second hinge means 31 is secured to its bottom surface. A shaft 32 having a rack gear 33 with rack teeth on one edge has a longitudinal axes 34. This shaft is rigid, and is pivotally mounted on second hinge means 31.

Lock means 35 is pivotally mounted on a horizontal third hinge means 36 to the platform, or more particularly to the support portion thereof, spaced below the first hinge means at an elevation below it. Preferrably it is directly beneath it, but this is not necessary.

The lock means includes a housing 37 which is freely rotated around a shaft 41 to which it is pivotally mounted. Shaft 41 comprises the third hinge means. The housing includes a channel 38 which has a substantial length along axis 34. It encircles and holds the shaft to permit it to slide axially in the housing. A cut out portion 39 exposes the teeth 40 of rack gear 33. Shaft 41 is rotatably mounted to the platform by brackets **41*a* and 41*b***.

An actuating lever 42 is also freely pivotable around shaft 41. An idler gear 43 is primed to shaft 41 and turns with shaft 41. Shaft 41 is not restrained against rotation, except when gear 43 is restrained. Teeth 44 on gear 33 always engage with the teeth of the rack gear.

Figure 3:
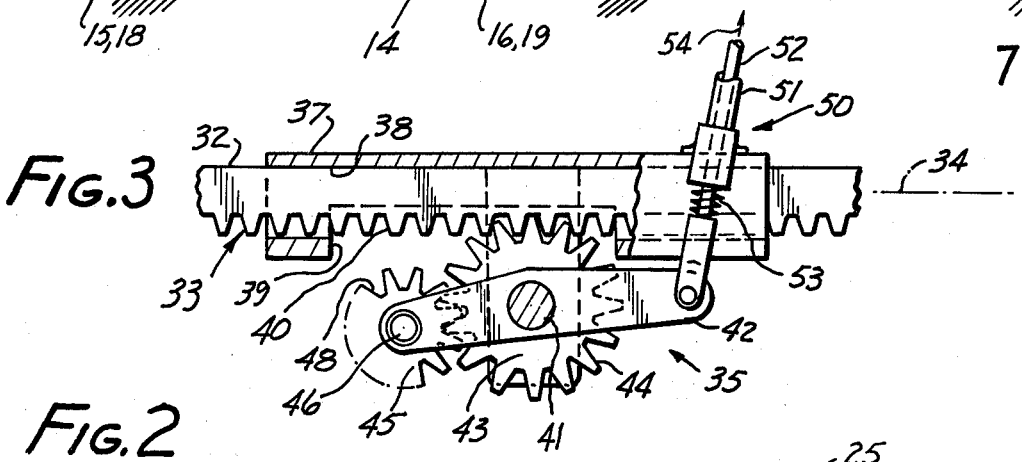
FIG. 3 is a fragmentary side elevation partly in cutaway cross-section, showing a portion of FIG. 2, and taken at line 3 — 3 therein.
Figure 4:
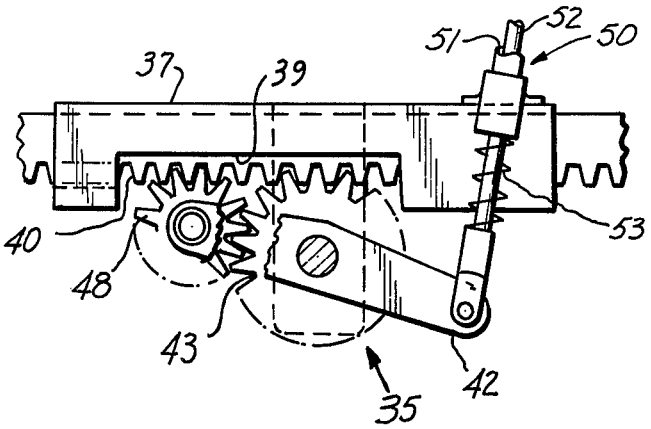
FIG. 4 is a view similar to FIG. 3 showing a locking condition.

A lock gear 45 is pivotally mounted by pin 46 to the left hand end of lever plate 42. The lock gear is held in such a position that its teeth 48 are always meshed with teeth 44 on the idler gear. They can also mesh with the teeth 40 of the rack gear in the locked condition (FIG. 4) and be released from teeth 40 in the unlocked condition (FIG. 3).

Locking and unlocking of this device is caused by rotation of lever plate 42. This is accomplished by a push - pull cable 50. The outer housing 51 of cable 50 is rigidly connected to housing 37. The inside cable 52 is connected to the lever plate on the opposite side of shift 41 from the lock gear. A bias spring 53 biases the cable and the lever clockwise in FIGS. 3 and 4. Counter clockwise motion is caused by force schematically illustrated by arrow 54 in FIG. 3.

Figure 5:
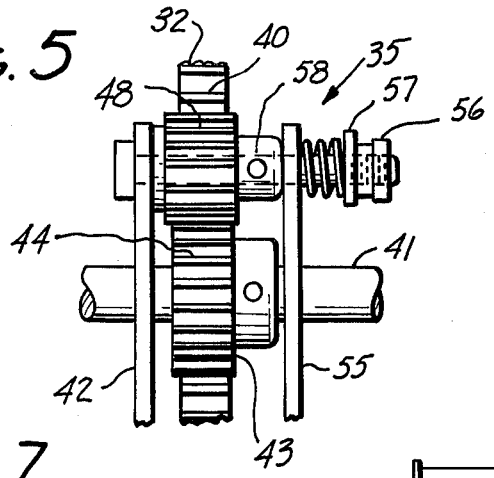
FIG. 5 is a detail of a portion of the system shown in FIG. 2.

In order to assure locking action of the lock gear it is advantageous to apply a drag to resist its rotation. This can conveniently be accomplished by the means shown in FIG. 5. This means is optional, and acts as a brake on the rotation of the lock gear relative to the lever plate. In this embodiment, pin 46 passes freely through a matching second lever plate 55 (the lever plates being joined as a pair). A nut 56 and washer 57 apply a bias force against lever plate 55 pressing it against shaft 58 of the lock gear, therby applying a braking force to this gear. The braking force can be increased by tightening nut 56 and decreased by loosening it.

As best shown in FIG. 1, the cable sheath 51 and cable 52 of the push - pull cable can be supported at a bracket 59 where the cable end is accessible to the operator so he can pull or push it. The push - pull cable is flexible so it can bend when the leaf goes up and down.

Figure 2:
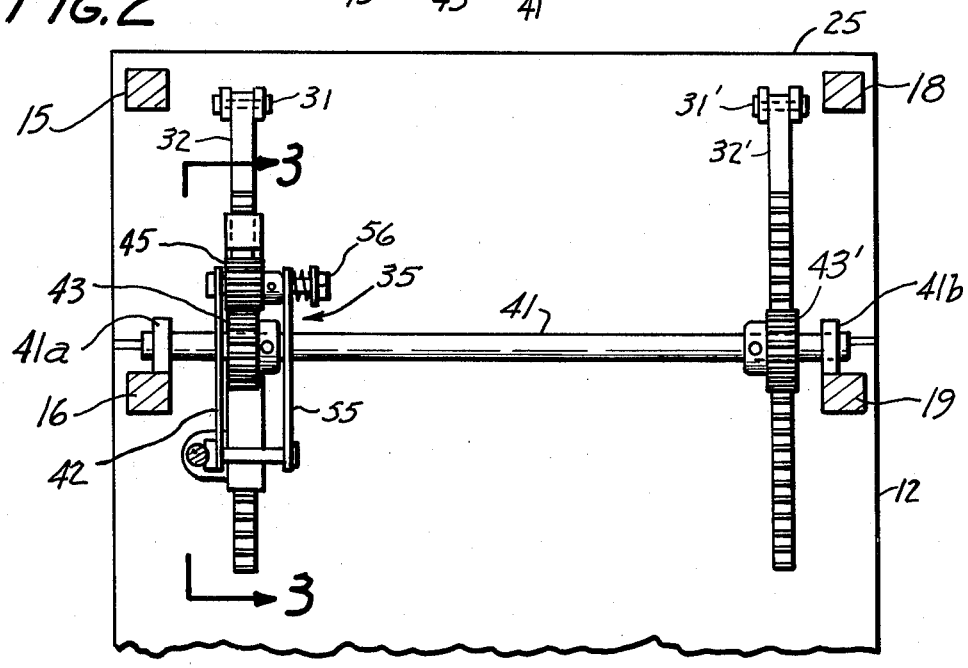
FIG. 2 is a fragmentary view taken beneath the portion of FIG. 1.

While the locking system as described can be provided singularly and will then be adequate for many purposes, it is better practice in equipment of this type to provide a supportive force at both sides of the leaf. However, only one lock means needs to be provided. Such an arragement is shown in FIG. 2, where a second three link system is provided indicated by identical numbers but with prime notation. It utilizes the lock means of the first set, and does not have to duplicate it because shaft 41 ties the two idler gears together. 43 and 43' are both pinned to the shaft. Therefore, locking of idler gear 43 will also serve to lock and prevent the turning of idler gear 43'.

This system is therby a three link system, meaning that there are three linear lengths of rigid devices between points of joinder. The first link is whatever structure is between the lock means, and the first hinge means. Because this reaction is taken up at the third hinge means, basically it means the structure between the first and the third hinge means. The second link is the structural connection between the first and second hinge means which is principally the structure of the leaf. The third link is between the second hinge means and the lock means or more correctly between the second and the third hinge means which is primarily the structure of the shaft and of that portion of the lock means which connects it to the third hinge means. The length of the third link is adjustable, and as a consequence so is the angularity of the leaf.

Figure 6:
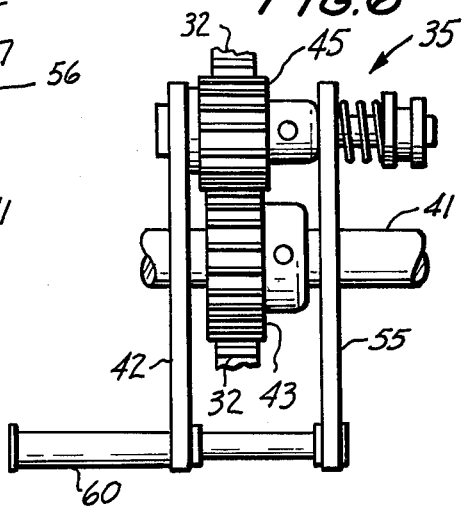
FIG. 6 is a fragmentary elevation similar to FIG. 5 showing another means of actuating the lock system.

In FIG. 6 there is shown another locking device with a different actuating means. Instead of push - pull cable, a handle 60 is attached to the lever plate which can be rotated by turning the handle to accomplish the same locking and unlocking action as the push - pull cable accomplishes. All other constructions are identical.

The operation of the device is as follows: With the device in the condition of FIG. 4 as a consequence of rotation of the lever plate by the push - pull cable by the handle, or by any other suitable means, the lock gear is meshed with the idler gear and with the rack teeth. Relative movement of these three terms is prevented by the locking of the teeth. Therefore the table leaf will remain in a selected angular position. Then, to unlock the device and change the leaf angle, it is only necessary to pull the cable 52 or to move handle 60 so as to turn the lever plate to the position shown in FIG. 3. This removes the lock gear from meshing with the rack teeth, and the shaft can move in the channel. This will rotate the idler gear and the lock gear freely (shaft 41 also turning when the idler gear is keyed to it) until the actuating means is again released. Should the bias spring the omitted as is done in FIG. 6, locking can be assured by drag on the lock gear, because if this gear cannot turn freely, then when the leaf moves downwardly it will rotate the idler gear clockwise in FIG. 3 and because the lock gear cannot readily turn around its own axis, it will be transported along with the idler gear around the idler gear's axis, rotating the lever plate with it. Finally it will come into meshing engagement with the rack and lock the three link system. This system is thereby fail-safe, either by use of the bias spring or by use of the drag on the lock gear, or both, as desired.

It will be observed that this system is proof against rotation and cannot tend to shake or jar loose. It is fully locked when the teeth are all engaged, and no movement of of the rack in either direction will be permitted by the interlocked gears. Thereupon this becomes a three link locking system, the length of one of the links being adjustable but lockable in an adjusted position to determine the angle. The device is elegant in its simplicity and totally reliable in its operation. This invention thereby provides a three link system with locking means to enable adjustment of, and to hold the adjustment of the length of the third link. It is obvious that other locking means can be provided to lock the length of the third link and its adjusted third setting which will be within the scope of this invention.

This invention is not to be limited by the embodiments shown in the drawings and described in the description, which are given by way of example and not of limitation, but only in accordance with the scope of the appended claims.

I claim:

1. In combination: a platform having a horizontal surface and an upright support beneath said horizontal surface, said support having a dimension of height; a horizontal first hinge means on said platform; a rigid leaf pivotally mounted to said platform by said first hinge means to permit the leaf to hinge around said first hinge means; horizontal second hinge means on said leaf spaced from first hinge means; a lock shaft having an axis of motion, and being pivotally mounted to said second hinge means; third hinge means attached to the support at an elevation below said horizontal surface; and releasable lock means pivotally mounted to said third hinge means, said lock shaft being engaged to said lock means for axial movement therein, whereby a three link locking system is created for the leaf as follows: a first rigid link between the third and first hinge means, a second rigid link between the first and the second hinge means, and a third rigid link between the second and third hinge means, said lock means being so constructed and arranged as releasably to lock the shaft thereto and at any shaft position in the range of permissible positions, thereby to adjust the length of the third link and the angle of the leaf, said three link system being rigid when the lock means is locked, in which said lock shaft bears rack gear teeth, and in which said lock means comprises an idler gear with teeth meshed to the rack gear teeth, and a lock gear having teeth always meshed to the idler gear teeth and so disposed and arranged that they can also be meshed with the rack gear teeth to lock the gears together or removed therefrom to enable the rack gear teeth to move relative to the idler gear.

2. Apparatus according to claim 1 in which the idler gear and a lever plate are mounted to a shaft, the lever plate being rotatable relative to said shaft, said lock gear being rotatably mounted to the lever plate, and in which means is provided to rotate the lever plate.

3. Apparatus according to claim 2 in which spring bias means biases said lever plate in a direction to cause the lock gear to mesh with the idler gear.

4. Apparatus according to claim 2 in which brake means restrains the rotation of the lock gear around its axis.

5. Apparatus according to claim 4 in which spring bias means biases the lever plate in a direction to cause the lock gear to mesh with the idler gear.

6. Apparatus according to claim 2 in which said means to rotate the lever plate is a handle on said lever plate.

7. Apparatus according to claim 2 in which said means to rotate the plate is a push - pull cable.

8. Apparatus according to claim 2 in which the lock means includes a channel in which the lock shaft shifts axially.

9. Apparatus according to claim 2 in which a plurality of said three link systems is provided, said systems sharing a single lock means and being interconnected to a shaft to which their respective idler gears are keyed.

* * * * *